US008520887B2

(12) United States Patent
Simidian, II et al.

(10) Patent No.: US 8,520,887 B2
(45) Date of Patent: Aug. 27, 2013

(54) FULL RANGE PLANAR MAGNETIC TRANSDUCERS AND ARRAYS THEREOF

(75) Inventors: Vahan Simidian, II, Newport Beach, CA (US); Dragoslav Colich, Costa Mesa, CA (US)

(73) Assignee: HPV Technologies, Inc., Irvine, CA (US)

( * ) Notice: Subject to any disclaimer, the term of this patent is extended or adjusted under 35 U.S.C. 154(b) by 1255 days.

(21) Appl. No.: 11/751,706

(22) Filed: May 22, 2007

(65) Prior Publication Data

US 2008/0019558 A1 Jan. 24, 2008

Related U.S. Application Data

(63) Continuation-in-part of application No. 10/919,018, filed on Aug. 16, 2004, now Pat. No. 7,242,788.

(60) Provisional application No. 60/845,049, filed on Sep. 15, 2006.

(51) Int. Cl.
*H04R 11/02* (2006.01)

(52) U.S. Cl.
USPC ..... 381/431; 381/408; 381/421

(58) Field of Classification Search
USPC ..... 381/414, 424, 431, 421
See application file for complete search history.

(56) References Cited

U.S. PATENT DOCUMENTS

| | | | | |
|---|---|---|---|---|
| 4,872,148 | A * | 10/1989 | Kirby et al. | 367/172 |
| 6,760,456 | B1 * | 7/2004 | Annaratone | 381/306 |
| 6,810,126 | B2 * | 10/2004 | Levitsky | 381/191 |
| 7,142,688 | B2 * | 11/2006 | Croft et al. | 381/431 |
| 7,631,723 | B2 * | 12/2009 | Ono et al. | 181/169 |
| 2002/0118856 | A1 * | 8/2002 | Croft et al. | 381/412 |
| 2002/0191808 | A1 | 12/2002 | Croft, III et al. | |
| 2004/0022408 | A1 * | 2/2004 | Mango et al. | 381/408 |
| 2004/0140545 | A1 | 7/2004 | Farnworth et al. | |

* cited by examiner

*Primary Examiner* — Davetta W Goins
*Assistant Examiner* — Amir Etesam
(74) *Attorney, Agent, or Firm* — Fish & Associates, PC

(57) ABSTRACT

Contemplated planar magnetic transducers include a magnet and diaphragm arrangement such that substantially homogenous vertical and high horizontal magnetic flux density is realized in the inter-magnet space. Most preferably, the diaphragm is a tensioned polymer membrane in which the voice coil covers a significant portion of the active portion of the membrane, and the magnets are rare-earth metal-type magnets of ultra-high strength. Particularly preferred planar magnetic transducers allow for exceptionally large excursion of the diaphragm in a substantially homogenous magnetic field at virtually no distortion, thereby providing heretofore unachieved sound pressure levels. Arrays of such and other transducers are disclosed that provide a full-range speaker with acoustic plane source characteristics.

15 Claims, 9 Drawing Sheets

Magnetic Flux Density along the vertical magnetic gap between two opposing magnets

Bx- Magnetic Flux Density between two rows of magnets in the plane of the diaphragm

MAD A9 Horizontal Directivity Plot

FULL RANGE PLANAR MAGNETIC TRANSDUCERS AND ARRAYS THEREOF

This application is a continuation-in-part of our allowed U.S. application with the Ser. No. 10/919,018, filed Aug. 16, 2004, and further claims priority to our U.S. provisional application with the Ser. No. 60/845,049, filed Sep. 15, 2006, both of which are incorporated by reference herein.

FIELD OF THE INVENTION

The field of the invention is loudspeakers, and especially planar magnetic speakers and arrays thereof.

BACKGROUND OF THE INVENTION

While the theory of planar magnetic transducers is conceptually relatively simple and has been known for several decades, planar magnetic transducers have found only limited acceptance and use in speakers, mainly due to difficulties associated with limited diaphragm excursion and magnetic field strength.

Due to the above difficulties and other disadvantages, currently known speakers with planar magnetic transducers typically exhibit relatively low sound pressure levels (SPL) and often significant distortion at higher SPL. While the excursion range of the diaphragm can be increased by increasing the distance between the magnets and the diaphragm, such increase is typically only achieved at the expense of loss in strength of the magnetic field. To remedy such problems, a second opposing row of magnets may be implemented to form a push-pull system. Unfortunately, the increase in SPL using such known system is relatively limited. Still further, and especially where multiple transducers are employed, inhomogeneities in physical diaphragm parameters will substantially affect accurate sound reproduction. Thus, currently known planar magnetic speakers are typically employed in the high-frequency range (e.g., as tweeters) and/or in speakers in which high sound pressure levels are not desired.

Therefore, while numerous speakers with planar magnetic transducers are known in the art, all or almost all of them suffer from one or more disadvantages. Consequently, there is still a need to provide improved devices and methods for planar magnetic transducers.

SUMMARY OF THE INVENTION

The present invention is directed to configurations and methods of full-range transducers, and especially planar magnetic transducers in which the magnets are arranged relative to each other to form large inter-magnet gaps with substantial and homogenous magnetic flux density in a plane normal to the diaphragm and with substantial magnetic flux density in a plane parallel to the diaphragm. Such arrangements together with the use of strong magnetic materials, the inter-magnet gap can be dimensioned to allow diaphragm excursions suitable for production of sound pressure levels well in excess of 120 db at 1 m distance. Such transducers are especially suitable for production of a speaker with acoustic planar source characteristics (e.g., where the variability in diaphragm tension is relatively low).

In one aspect of the inventive subject matter, a full-range transducer includes a plurality of magnets and a diaphragm disposed between at least two of the magnets, wherein the magnets are arranged relative to each other such that (a) a distance between the at least two of the magnets is at least 4 mm, (b) average magnetic flux density between the at least two magnets in a plane perpendicular to the diaphragm is at least 0.35 T and substantially homogenous, and (c) average magnetic flux density between a third magnet and one of the at least two magnets in a plane of the diaphragm is at least 0.3 T, wherein at least 60 % of the active area of the diaphragm is covered by the voice coil.

Even more preferably, the distance between the two magnets is at least 4.5 mm, and most preferably at least 5 mm, and/or the average magnetic flux density between the two magnets in a plane perpendicular to the diaphragm is at least 0.45 T, and more preferably at least 0.55 T. Additionally, or alternatively, the average magnetic flux density between the third magnet and one of the at least two magnets in a plane of the diaphragm is at least 0.35 T and more preferably at least 0.4 T. It is still further preferred that at least 70%, and more typically at least 80% of the active area of the diaphragm are covered by the voice coil, and that the diaphragm comprises a tensioned polyester (e.g., MYLARTM™) membrane, or even more preferably a tensioned polyimide (e.g., KAPTONTM™) membrane, which most preferably has the same tension over at least 80% of the active area. With respect to the magnets it is generally preferred that the plurality of magnets (typically comprising a rare earth metal) are on each side of the diaphragm arranged in parallel with alternating polarity in neighboring magnets and in same polarity in opposing magnets. Most typically, at least some of the magnets are coupled to each other via a spacer element.

In further preferred aspects of the inventive subject matter, contemplated transducers are coupled together to form a transducer array, which will advantageously have characteristics of an acoustic plane source. Therefore, in another aspect of the inventive subject matter, a method of producing an array of speakers for directional transmission of sound having a plurality of wavelengths includes a step of providing a plurality of full-range transducers, wherein at least two of the transducers are configured to produce a sound pressure level of at least 90 db at a distance of 1 meter. In such methods, the transducers are arranged such that (a) for wavelengths less than the array size, the geometrical arrangement of the transducers controls directionality of sound transmission, (b) for wavelengths of about the array size, the total size of the array of the transducers controls directionality of sound transmission, (c) for wavelengths larger than the array size, cardioid or dipole configuration controls directionality of sound transmission, and (d) the loss of sound pressure level is less than 3 db for every doubling of distance to the array.

Most preferably, at least two of the transducers are flat panel speakers (full range [100 Hz to 20 kHz] transducer with flat diaphragm, typically with characteristics similar to those in planar magnetic speakers) or planar magnetic speakers, and the array has a substantially flat n1×n2 arrangement with an active membrane area for each transducer of between 150 $cm^2$ and 1000 $cm^2$, wherein n1 and n2 are independently integers between 2 and 12, inclusive, and wherein n1/n2 is between 0.4 and 2.5, inclusive. Most desirably, the full-range transducers have a transducer-to-transducer variability of sound pressure level of less than 1 db over a frequency range of 100 Hz to 20 kHz, and/or are configured to produce a sound pressure level of at least 100 db at a distance of 300 meter.

Various objects, features, aspects and advantages of the present invention will become more apparent from the following detailed description of preferred embodiments of the invention.

DETAILED DESCRIPTION

The inventors discovered that selected parameters dramatically affect the performance of a planar magnetic transducer, and that proper choice of such parameters will allow fabrication of high-output transducers with heretofore unknown sound pressure levels, with substantial lack of distortion, and a capability combine with additional transducers to thus form an array of planar magnetic transducers in which the array has characteristics of a plane source.

Figure 1A:
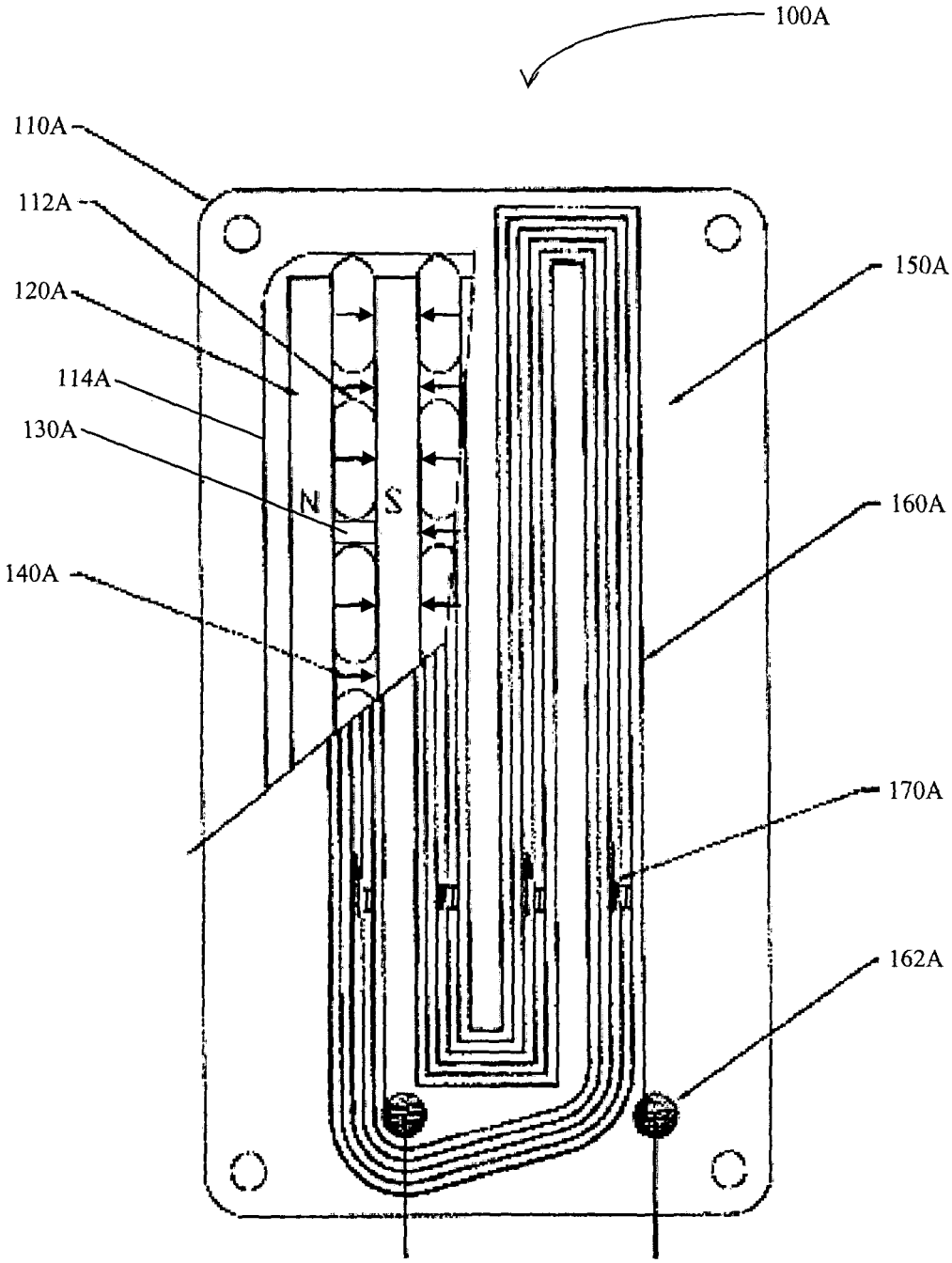
FIG. 1A is a schematic of an exemplary planar magnetic transducer according to the inventive subject matter.

An exemplary planar magnetic transducer 100A is schematically illustrated in FIG. 1A in which a portion of the diaphragm is removed to expose underlying bar magnets, spacer elements, and other components. Here the stator frame 110A has a plurality of perforations 112A through which sound is emitted (and heat dissipated). Bar magnets 120A are coupled to the stator in a parallel fashion with alternating polarity (as indicated by North [N] and South [S]). Proper mounting alignment and distance of the magnets is maintained by spacer elements 130A, which also reduce tension on the coupling material that holds the magnets to the stator. Such spacers are particularly advantageous where the magnets are very strong, as at the relatively small gap between adjacent magnets leads to significant attraction between the magnets. Arrows 140A indicate the direction of the magnetic field between the adjacent magnets. The diaphragm is 150A is mounted to the stator 110A and further includes conductive trace 160A, which runs above the gap between adjacent magnets and has a layout such that current flows unidirectional with respect to the magnetic field between adjacent magnets as indicated by arrows 170A. Both ends of the conductive trace terminate in electric terminals 162A. The active (i.e., moving) area of the diaphragm is located within the space defined by wall 114A that forms part of the cavity (see also below).

Figure 1B:
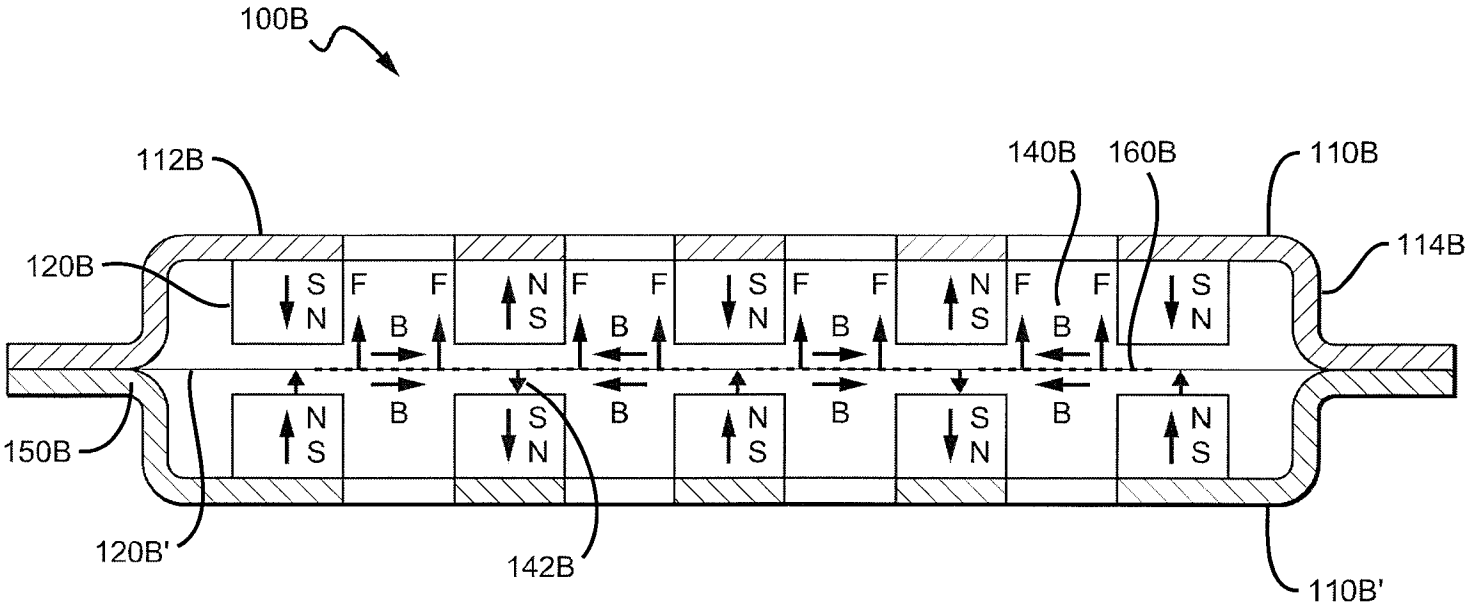
FIG. 1B is a schematic of a cross section of an exemplary planar magnetic transducer according to the inventive subject matter.

FIG. 1B depicts a vertical cross section of an exemplary planar magnetic transducer 100B in which the housing has upper and lower stators 110B and 110B', respectively. Disposed between the stators is the diaphragm 150B, which is also centered between opposing magnets 120B and 120B' such that opposing magnets face each other with the same polarity (as indicated by North [N] and South [S]). As above, the stators have 114B a wall to define a cavity to accommodate the magnets and the diaphragm, and perforations 112B to allow sound and heat to escape. Horizontal magnetic flux is indicated by 140B while vertical magnetic flux is indicated by 142B. As current flows through the conductive trace 160B, which is disposed in the magnetic fields, the diaphragm is forced to move in the direction as indicated by the letter F (of in the opposite direction as the current reverses.

It is generally contemplated that the planar magnetic transducers presented herein will have magnets that provide a relatively high magnetic field strength in the x-axis (defined as the axis that is parallel to the plane of the diaphragm). Therefore, in especially preferred aspects, magnets will include neodymium or other rare earth metals alone or in combination with one or more rare earth metals, iron, and/or boron.

In preferred aspects of the inventive subject matter, the magnets are bar magnets arranged in an array of parallel bars with opposing neighboring polarity. Most preferably, a second series of corresponding bar magnets is facing the first array with a same polarity to thereby form a push-pull system. However, numerous alternative arrangements are also deemed suitable and include curved or otherwise irregularly shaped bar magnets, ring magnets, etc., so long as a magnetic gap can be achieved with properties that allow large diaphragm excursion in a magnetic field of at least 0.3 T (in x-axis and y-axis).

Regardless of the specific arrangement of the magnets, it is especially preferred that the magnetic field strength in the x-axis between the magnets is at least 0.35 T, more preferably at least 0.4 T, even more preferably at least 0.45 T, and most preferably 0.5 T and higher. Still further, the inventors discovered that substantially increased performance is obtained in magnet arrangements where at least 70%, more preferably at least 80%, and most preferably at least 85% of the space between the magnets in the y-axis has a substantially homogenous magnetic field strength of at least 0.4 T, even more preferably at least 0.45 T, and most preferably 0.5 T and higher. Therefore, the average magnetic flux density between a third magnet and one of the at least two magnets in a plane of the diaphragm is at least 0.3 T (average magnetic flux density as used herein refers to the magnetic flux density that is present over at least 60% across the gap [either between opposing or adjacent magnets]).

Figure 2A:
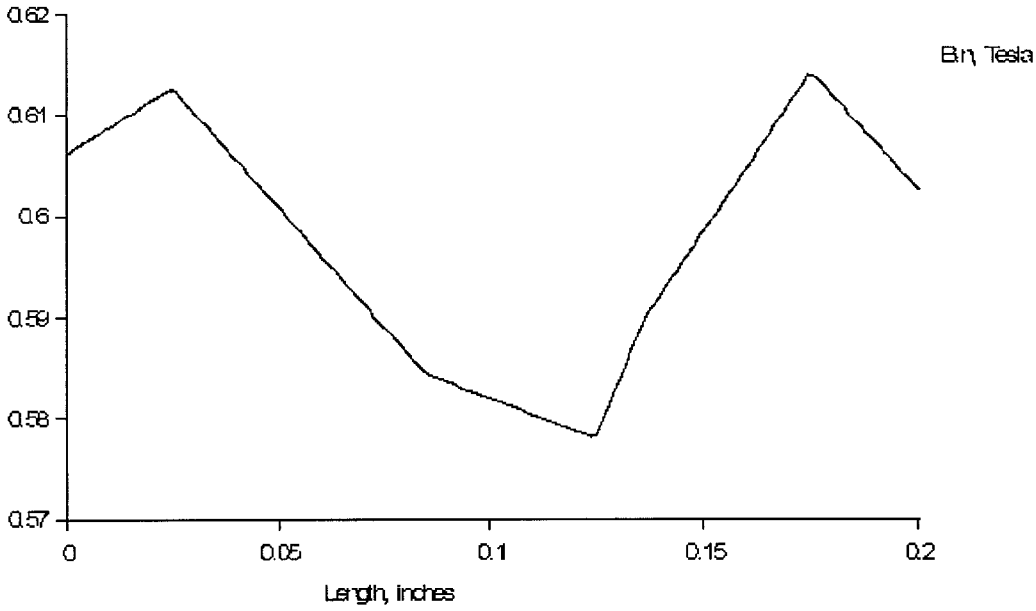
FIG. 2A is a graph illustrating magnetic flux density in the vertical gap between two bar magnets.
Figure 2B:
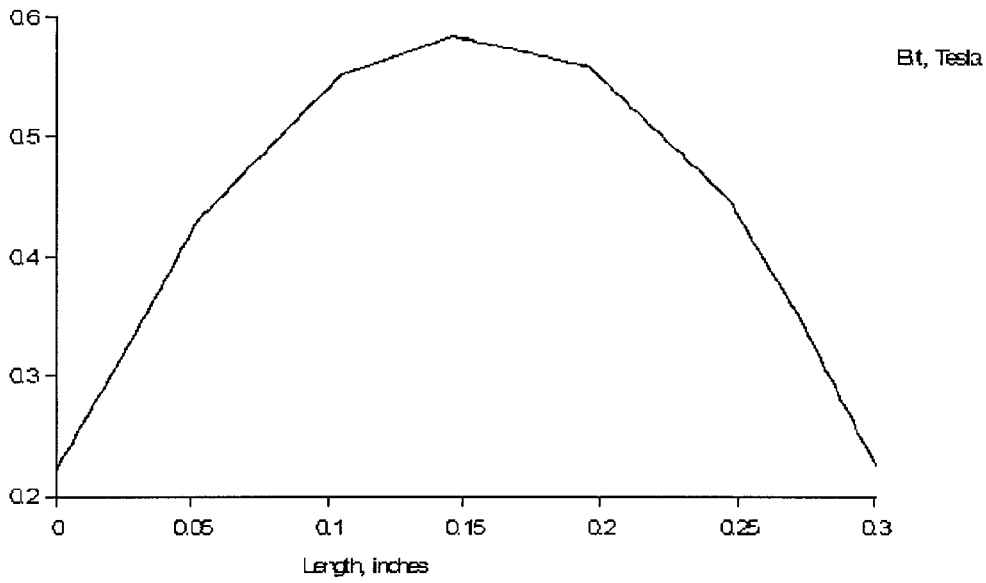
FIG. 2B is a graph illustrating magnetic flux density in the horizontal plane between two bar magnets in the plane of the diaphragm.

A typical result of measurement of the magnetic field strength in y-axis is shown in FIG. 2A (within vertical distance between magnet and diaphragm as indicated), while FIG. 2B depicts the measurement of the magnetic field strength in x-axis magnets at a vertical distance from the magnet equivalent to the diaphragm distance. As can be taken from the Figures, the magnetic field strength in y-axis is extremely homogenous and strong over a large range of the vertical gap between the magnets. In such arrangements, it is typically preferred to position the voice coil (or plurality of traces of the voice coil) such that the coil is exposed to a magnetic field strength in the x-axis of at least 0.3 T, more preferably at least 0.35 T, and most preferably at least 0.4 T. Depending on the particular configuration of the magnets, it should be recognized that the exact number of traces for the voice coil may vary considerably. Thus, single and multiple traces (typically parallel) are especially contemplated, wherein at least 50%, more typically at least 60%, and most typically at least 70% of the active (moving) diaphragm area will be covered by the voice coil (the term "voice coil" as used herein refers to the conductive trace on the diaphragm, and where multiple traces are adjacent to each other as shown in FIGS. 1A and 1B, the term voice coil also includes the space between conductive traces that are disposed at and over the gap between two adjacent magnets).

With respect to the gap, it is generally contemplated that the vertical gap between two opposing magnets (that will typically exhibit the same polarity) is determined to a relatively large degree by the strength of the magnetic materials used in the magnets and the desired current to the voice coil. However, in particularly preferred aspects, the gap between two opposing magnets will be at least 3.5 mm, more preferably at least 4.5 mm, and most preferably at least 5.0 mm. Such gap width is especially preferred where the diaphragm is positioned in a vertical distance from the magnets that ensures an average magnetic field strength of at least 0.4 T, and more typically at least 0.5 T in direction of the x-axis. Thus, average magnetic flux density between the at least two magnets in a plane perpendicular to the diaphragm is at least 0.35 T and substantially homogenous (substantially homogenous refers to an absolute numerical deviation of less that 15%). As a consequence, and at least in part due to the relatively strong and homogenous magnetic field strength across a substantial portion (at least 70%, more typically at least 80%) of the vertical gap between the magnets, the diaphragm will have a substantially improved range of excursion and will be driven with almost constant force. Thus, and also due to further factors addressed below, dynamic range and efficiency is substantially increased, total harmonic distortion is substantially decreased, allowing SPL levels and clarity that were heretofore not achievable. Viewed from a different perspective, it should be appreciated that the entire radiating area is directly and uniformly driven by the strong magnetic field.

It is contemplated that numerous types of magnets are suitable for use in conjunction with the inventive subject matter presented herein, and especially suitable magnets include neodymium magnets with a surface field of at least 2000 Gauss, more preferably at least 2500 Gauss, even more preferably at least 3000 Gauss, and most preferably at least 3500 Gauss. Viewed from another perspective, especially preferred magnets include neodymium magnets with iron and/or boron of varying grades (e.g., N35, N38, N42, N50, N54), which preferably have a temperature rating for operation up to temperatures of 100° C., more preferably 120° C., and most preferably 150° C. (and even higher). Alternatively, in less preferred aspects, suitable magnets also include samarium-cobalt magnets, and even less preferably electromagnets.

It should be noted that the magnetic field density is very linear between rows of magnets as well as along the depth of the magnetic gap. This creates linear force that moves diaphragm back and forth with minimum distortion. The diaphragm is properly tensioned and stretched on a perfectly flat surface of the active stator. This, together with very strong uniform driving force evenly distributed across the surface of the diaphragm, provides excellent sound quality with extremely low distortion. With one Watt of power, a transducer presented herein typically has 0.1-0.2% distortion within most of its operating frequency range.

It should further be noted that the magnets are preferably arranged such that North and South poles alternate in neighboring magnets, and that the steel stators close the magnetic circuits. Thus, the stators serve more than one purpose: (a) to provide a mounting support for the magnets, (b) to close the magnetic circuits between the magnets, and (c) to provide a flat surface onto which the stretched diaphragm is bonded. On one of the stators (the active stator), the thin diaphragm with printed conductive coil is stretched and bonded, and the conductive traces are centered between magnets in a predefined pattern. When the amplified signal is brought to the transducer terminals, it creates an alternating current that flows through the conductive traces. The current interacts with the magnetic field and creates the force that moves the traces to one side. Traces are arranged on the diaphragm surface such that force moves them all to one side. When the current changes direction, force moves all traces to the opposite side. Because traces are strongly bonded to the diaphragm surface, the whole diaphragm moves back and forth as a piston. Even though the diaphragm is flexible, it exhibits pistonic movement because conductive traces cover more than 60%, more typically more than 70, and most typically more than 80% of its active (moving) surface. When the diaphragm moves back and forth according to the signal change, it creates a sound. Air escapes the transducer through the holes in the stator face. In the basic configuration, contemplated transducers operate as a dipole. Dipole speakers create the sound on both sides of the diaphragm with equal intensity, but opposite phase. Therefore, front and rear sound waves meet on a side of the transducer and cancel. This creates a typical dipole figure of eight dispersion pattern (see below). Thus, sound on the side, top and bottom is almost completely canceled. If a dipole transducer is mounted in a closed cabinet it becomes monopole and radiates only on the front. In the low frequency range monopole is omnidirectional (radiates sound all around the speaker with equal intensity) and may cause too much output around the speaker in some applications. If an open enclosure was used and rear waves are absorbed, the transducer becomes cardioid. Cardioid dispersion keeps sound cancellation on its sides with greatly reduced rear radiation As the configurations above allow for substantial application of force to the diaphragm, the inventors recognized that proper diaphragm tension and installation is of significance to the performance of contemplated transducers, and that uniformity in stretching the diaphragm (i.e., membrane) is a significant contributor to the high performance. Thus, in particularly preferred aspects of the inventive subject matter, it is contemplated that at least 85%, more typically at least 90%, and most typically at least 95% (and even higher) of the active area of the diaphragm will have substantially the same tension (i.e., force required for a specific deflection at a specific location has no more than 10% absolute variation to the force required for the same deflection at another location). The proper tension will typically depend on the particular material employed, and it is contemplated that a person of ordinary skill will be apprised of suitable tension ranges for particular materials. In one example, various polyesters, and especially MYLARTM ™(DuPont: Polyethylene terephthalate film) is employed as diaphragm material and includes voice coil traces photolithographically deposited thereon. Alternatively, and especially for very high SPL, the diaphragm material may also comprise a polyamide film, including KAPTONTM ™(DuPont: Condensation product of a diamine and pyromellitic acid). Suitable tension ranges are well known to the artisan for such materials, and all of these tensions (essentially up to 50%, more preferably up 70%, even more preferably up 85%, and most preferably up 95% of rupture force) are deemed suitable for use herein.

Furthermore, it should be appreciated that the forces for tensioning the diaphragm in x-and y-direction of the diaphragm may be identical or may be different. For example, in one embodiment, the diaphragm is tensioned with equal force, while in other diaphragms, the forces differ at least 10%, and more typically at least 25%. Regardless of the manner of tensioning, it should be appreciated that preferred manners of tensioning will allow quantifiable application of force to thereby ensure consistent batch-to-batch tensioning. While the diaphragm may be pre-tensioned in a carrier and be mounted to the frame in the carrier in the pre-tensioned state, it is generally preferred that the diaphragm is tensioned and that the frame (including the magnets and other components) is mounted to the tensioned diaphragm while under tension. There are numerous manners of mounting known in the art and suitable manners include attachment using setting resins, glues, and other chemical compounds. Alternatively, in less preferred aspects, clamps and/or tensioning ridges may also be suitable. In still further contemplated aspects, tensioning and mounting may also use commercially available services (e.g., tension/mounting protocol 14-1 of HPV Technologies).

It should be especially appreciated that uniform diaphragm tensioning will significantly provide dampening at the resonance frequency, ensure homogenous frequency response and reduce distortion. Thus, uniformity of tensioning of at least 90-95% of the active diaphragm area is typically preferred. Alternatively, or additionally, dampening materials may be included and suitable materials include all materials that allow for air flow through the material. However, particularly preferred materials include non-woven cloth and felts (which also may provide physical protection from environmental agents/forces).

Conductive traces may be formed on the diaphragm in all manners known in the art and will preferably include photolithographic methods, melt-pressing of conductive material into the diaphragm, in-situ generation of conductive traces in the diaphragm material, etc. Moreover, while it is generally preferred that the voice coil is present on only one side of the diaphragm, traces may also be disposed on both sides of the diaphragm. Additionally, where desirable, the diaphragm with conductive traces may also be laminated between two further (and preferably thin) layers of material to provide electrical insulation where the diaphragm or speaker is exposed to conductive materials, and especially water.

Figure 3:
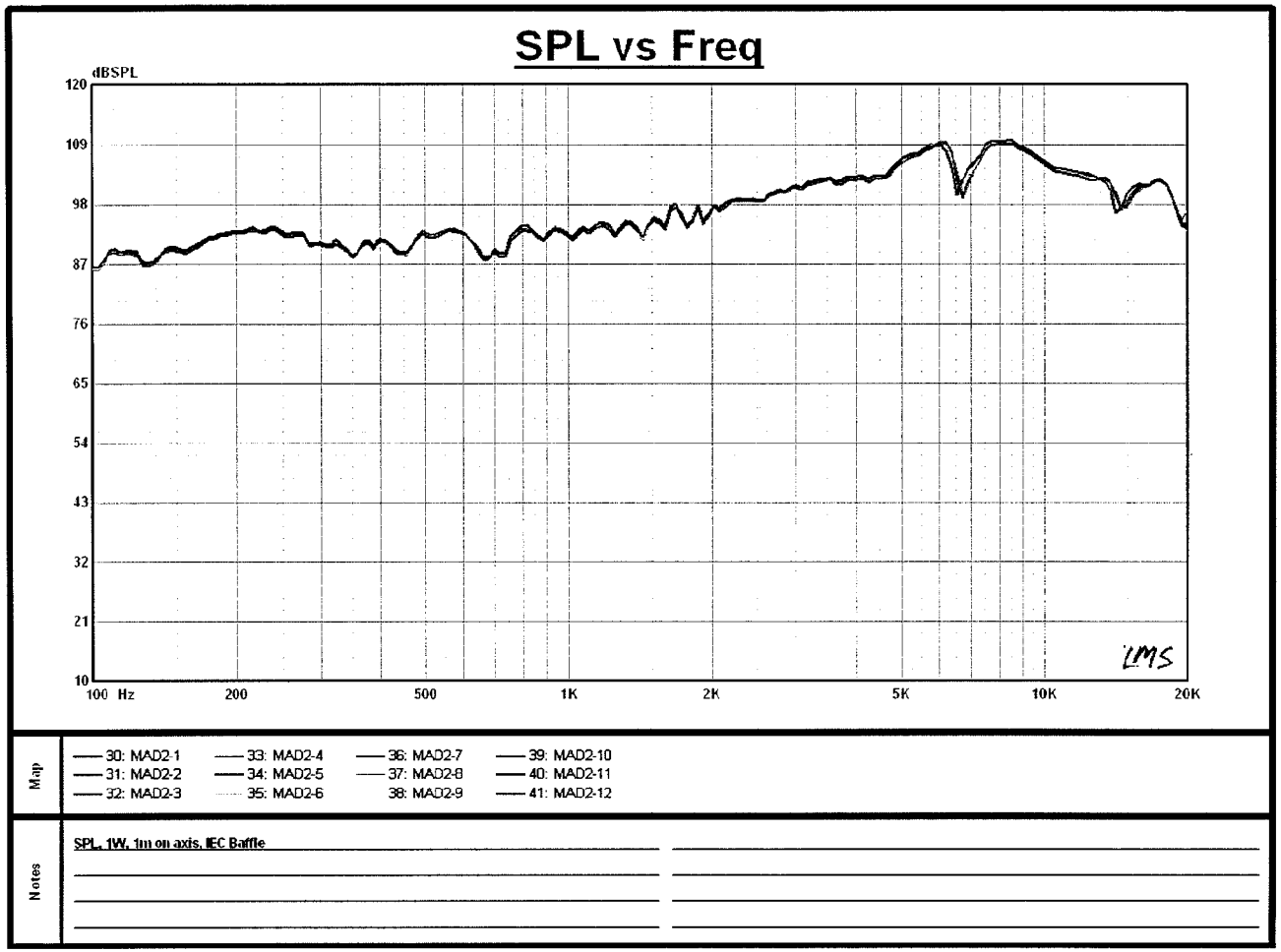
FIG. 3 is a graph illustrating an overlay of measured sound pressure levels of twelve different magnetic planar transducers over the range of 100 Hz to 20 kHz.

As a further advantageous aspect of homogenous stretching of the diaphragm, it should be noted that transducers fabricated according to the inventive subject matter will exhibit unparalleled low inter-device variability. Most typically, the frequency response curve over the entire spectrum from 100 Hz to 20 kHz will have inter-device deviations of less than +/−1 db, more typically less than +/−0.7 db, and most typically less than +/−0.5 db. FIG. 3 depicts a typical result of frequency response curve determinations in which 12 transducers were tested for inter-device variability. As can be seen from the graph, there is substantially no inter-device variability (maximum measured was about +/−0.5 db). Measured frequency response during the regular quality control testing shows remarkably narrow spread of curves variations and are typically within 1 dB (+/−0.5 dB). If one overlays hundreds of curves on top of each other all those graphs would look like one thick line. This is quite impressive compared to conventional drivers where consistency of frequency response graphs from driver to driver can vary quite a lot, most typically between 3-6 dB. In contrast, drivers presented herein are almost like clones and provide a perfect solution for arraying them into any size or shape surface array.

Moreover, due to the size of the diaphragm and substantial dampening at the low end of frequencies, it should be appreciated that the transducers contemplated herein will accurately reproduce sound over a wide spectrum of frequencies with substantial efficiency. A single planar magnetic transducer can therefore be employed as a full range speaker, and particularly for voice transmission at SPL values heretofore unknown.

Figure 4A:
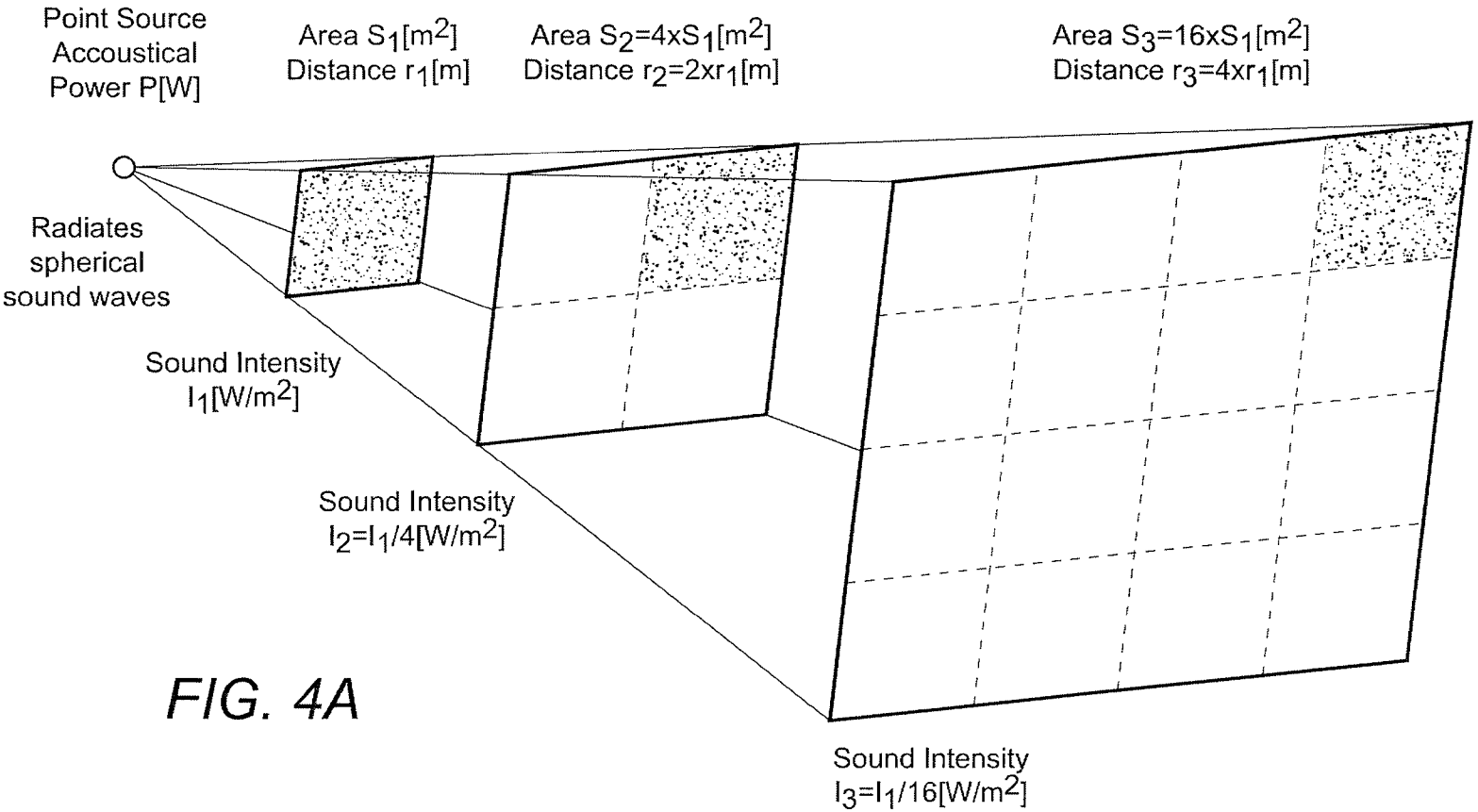
FIG. 4A is a schematic illustration of loss of sound pressure level of an acoustic point source over distance.
Figure 4B:
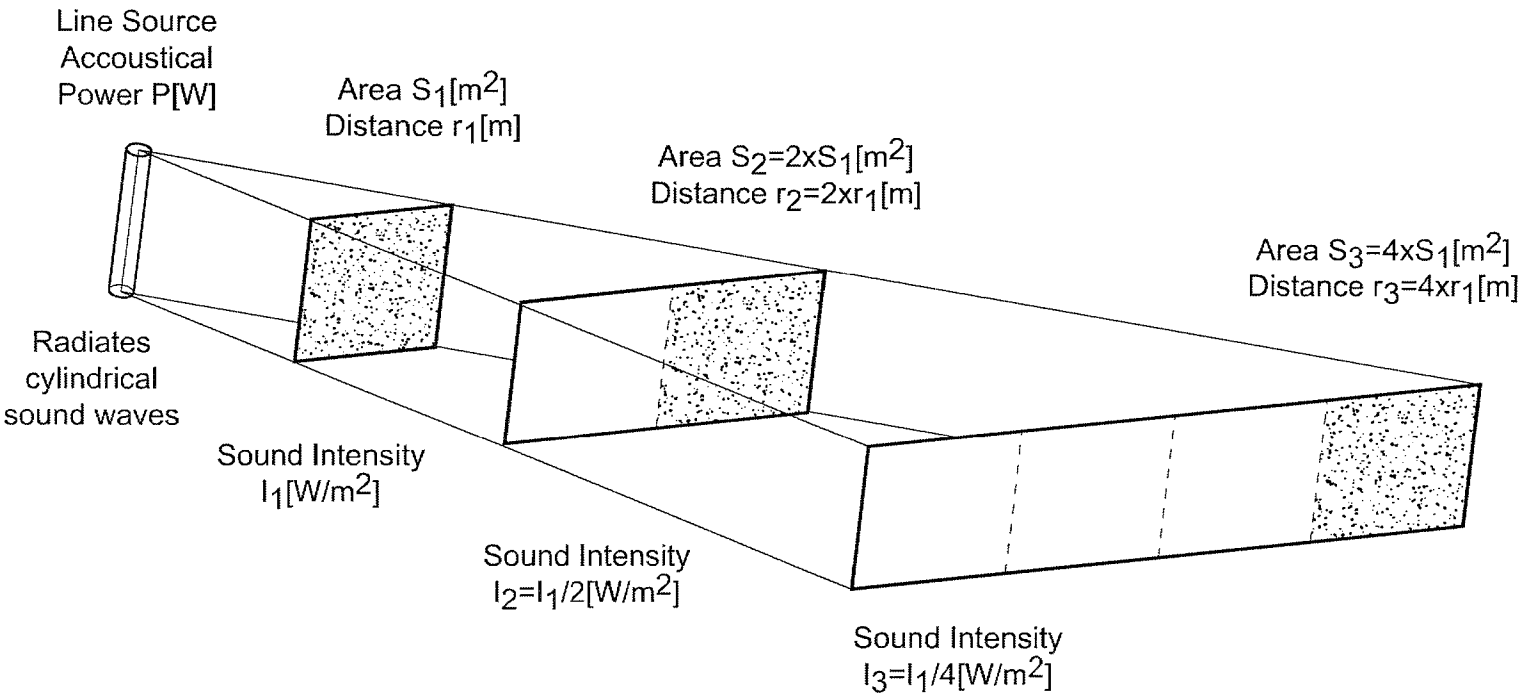
FIG. 4B is a schematic illustration of loss of sound pressure level of an acoustic line source over distance.
Figure 4C:
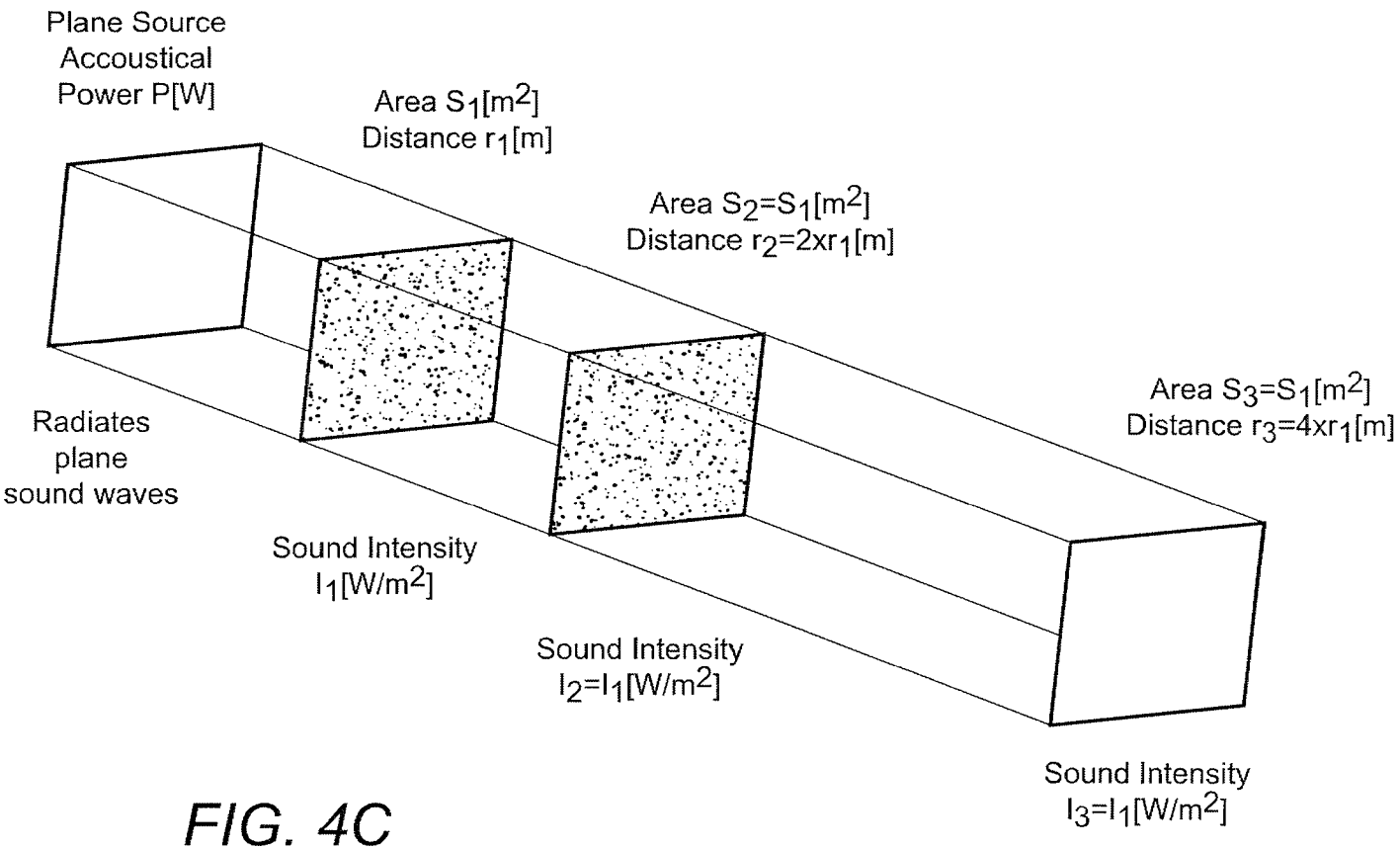
FIG. 4C is a schematic illustration of loss of sound pressure level of an acoustic plane source over distance.

Contemplated transducers have extremely fast transient response due to very strong and linear electromagnetic force and a very lightweight whole surface driven diaphragm. As the mass of the diaphragm is so light that it becomes comparable to the mass of the air it moves during operation, very high acceleration is achieved. Therefore, very sharp peaks can be accurately reproduced using the speakers according to the inventive subject matter and small detail in the sound is presented perfectly well, regardless of loudness. Among other advantages, the planar magnetic transducers presented herein will allow for speakers that have SPL levels well above 80 db, more typically above 100 db, even more typically above 120 db, and most typically above 130 db at substantially no audible distortion. As a result, speakers having arrays of a plurality of planar magnetic transducers are able to project sound over substantial distances (e.g., well above 1 mile at heretofore not achieved SPL and clarity). Such remarkable properties become more apparent if one considers contemplated speakers and arrays thereof as having characteristics of an acoustic plane source. FIGS. 4A-4C schematically illustrate substantial differences in acoustic source types, wherein FIG. 4A depicts a point source that can be viewed as a pulsating point from which sound emanates in spherical geometry. As the sound travels, the intensity drops off by 6 db for each doubling of the distance. Similar problems occur with a line source as indicated in FIG. 4B. Here, the line source can be viewed as a pulsating line from which the sound emanates in cylindrical manner. As the sound travels, the intensity drops off by 4 db for each doubling of the distance. In contrast, an acoustic plane source can be viewed as a pulsating plane from which sound emanates substantially without loss of transmission (in an ideal model) in a parallel fashion as schematically illustrated in FIG. 4C, thus allowing production of arrays with highly directed sound transmission (see below).

Consequently, it should be particularly appreciated that arrays from contemplated planar magnetic transducers are particularly advantageous where SPL of greater than 80 db, more typically greater than 100 db, even more typically greater than 120 db, and most typically greater than 130 db are desired. Suitable arrays may include at least 2, more typically 4, and most typically at least 6-96 transducers, wherein preferably all of the transducers exhibit an inter-device variability of less than +/−1.0 db, more preferably less than +/−0.7 db, and most preferably less than +/−0.5 db over a range of 100 Hz to 20 kHz. Transducers in contemplated arrays are typically electrically connected in serial/parallel fashion as desired. Arrays constructed using contemplated transducers were shown to have remarkable ability to transmit sound at substantial SPL over distances of several miles. Furthermore, it should be appreciated that depending on the geometry of the array, dispersion can be controlled to cover a relatively narrow field where multiple transducers are operated in a single plane.

Figure 5:
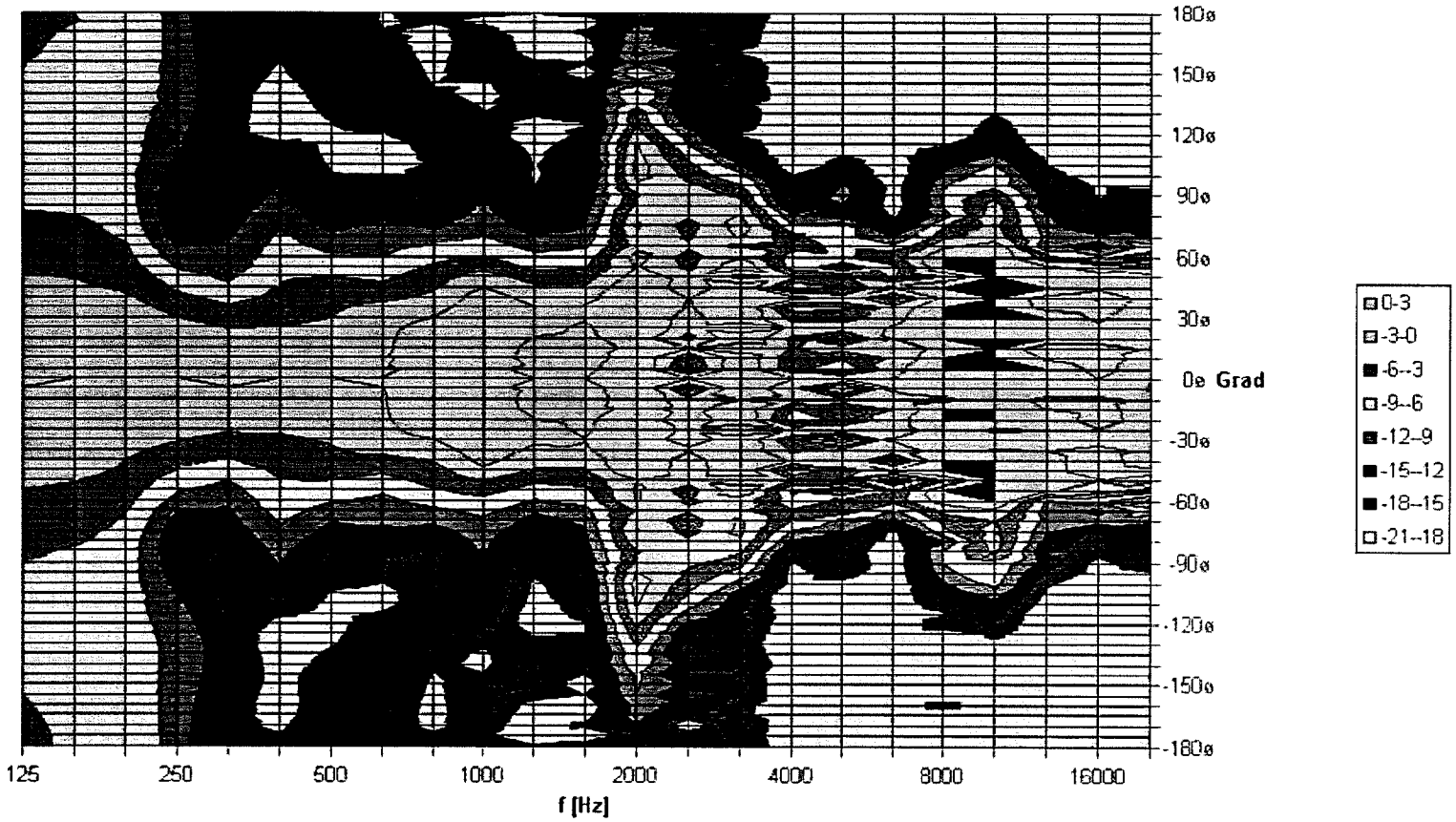
FIG. 5 is a graph illustrating directivity of an exemplary array over a frequency range of 125 Hz to 20 kHz.

For example, typical dispersion values for arrays will be between about 30 degrees and 2 degrees, and more typically between 15-5 degrees (e.g., for arrays having 4 to 24 transducers). Alternatively, the transducer arrays may also be in a configuration other than flat and especially contemplated configurations include convex array that may or may not have a splay. Similarly concave configurations are also contemplated. FIG. 5 depicts a graph in which sound pressure levels of a 9×12 transducer array (in dipole configuration and with a splay angle of 90 degrees) are plotted as a function of frequency (x-axis) and angle from the center of the speaker (y-axis). SPL measurements were taken in a horizontal plane and drops in SPL are indicated in different gray shadings. The plot depicts the SPLs along a horizontal perimeter at indicated angles around the array as a function of the frequency. As can be seen from the graph, the SPL is remarkably focused and homogenous within the splay angle throughout the entire frequency spectrum reflecting the array's remarkable directionality throughout the entire frequency range.

Consequently, the inventors also contemplate methods and arrays of speaker arrays for directional transmission of sound having a plurality of wavelengths in which a plurality of full-range transducers (flat panel or planar magnetic transducer) are coupled together to form an array. Most typically, at least two of the transducers can produce a sound pressure level of at least 90 db at a distance of 1 meter, and the transducers are arranged such that (a) for wavelengths less than the array size, the geometrical arrangement of the transducers controls directionality of sound transmission, (b) for wavelengths of about the array size, the total size of the array of the transducers controls directionality of sound transmission, (c) for wavelengths larger than the array size, cardioid or dipole configuration controls directionality of sound transmission. Such speakers will (especially when used in a generally flat array) exhibit loss of sound pressure level of less than 4 db, more typically less than 3 db, and most typically less than 2 db for every doubling of distance to the array.

While contemplated arrays may have numerous configurations (e.g., horizontal and/or vertical splay to open up sound dispersion, or pyramidal arrangement of the transducers), it is generally preferred that the array has a substantially flat n1×n2 arrangement with an active transducer membrane area of between 150 $cm^2$ and 1000 $cm^2$. In such arrays, n1 and n2 are independently integers between 2 and 12, inclusive, and the ratio of n1/n2 is between 0.4 and 2.5, inclusive. Of course, it should be recognized that the numbers for n1 and n2 may also be significantly larger that 12, and suitable numbers include numbers up to 20, up to 50, up to 100, and even more. It is especially preferred that contemplated arrays include full-range transducers with a transducer-to-transducer variability of sound pressure level of less than +/−1 db over a frequency range of 100 Hz to 20 kHz. Depending on the signal strength and size, preferred arrays will produce a sound pressure level of at least 100 db over a distance of at least 300 meter.

While contemplated transducers are preferably operated in an array configuration, it should be appreciated that they may also be operated in concert with non-planar magnetic devices. However, it is generally preferred that contemplated array devices are employed in applications in which propagation of an acoustic signal at relatively high SPL is desired over a relatively long range while maintaining the quality of that signal. For example, where the transducer array is employed as a concert speaker, it has been shown that such speakers can cover areas populated by several hundred thousand people. Therefore, stadium, auditorium, and open-air use for music reproduction over a distance of at least 300 m, more typically at least 500 m, and most typically at least 800 m is contemplated wherein the SPL at such distance is no less than 80 db. Generally, such arrays will reproduce the entire frequency spectrum between 30, more typically 50, and most typically 100 HZ to about 20 kHz.

In still further especially contemplated aspects, and especially where the diaphragm and associated electrical connectors are electrically insulated (e.g., by sandwiching between two thin polymer sheets) , it should be recognized that the transducers and transducer arrays presented herein may also be employed in an environment that is subject to moisture, rain, or even in an submerged environment. For example, contemplated speakers and arrays may be used as underwater speakers, which will take full advantage of the acoustic planar source character of the speakers. Directionality and SPL will thus be significantly higher than with conventional speakers. Among other uses, directed sound may be used as a defensive measure, to provide a directed ping in sonar applications, or to provide an audible and directed audio signal to underwater personnel.

Thus, specific embodiments and applications of full range planar magnetic transducers and arrays thereof have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Furthermore, where a definition or use of a term in a reference, which is incorporated by reference herein is inconsistent or contrary to the definition of that term provided herein, the definition of that term provided herein applies and the definition of that term in the reference does not apply.

What is claimed is:

1. A full-range transducer comprising:

a frame to which are coupled a plurality of magnets and a diaphragm under tension wherein the tensioned diaphragm is disposed between at least two of the magnets, wherein at least 85% of an active area of the diaphragm has substantially the same tension, and wherein the magnets are arranged relative to each other such that:

(a) an intermagnet gap between the at least two of the magnets is selected such as to allow diaphragm excursions of the tensioned diaphragm for production of sound pressure levels of at least 120 db at 1 m distance;

(b) average magnetic flux density between the at least two magnets in a plane perpendicular to the diaphragm is at least 0.35 T and is substantially homogenous across at least 70% of a distance between the at least two magnets;

(c) average magnetic flux density between a third magnet and one of the at least two magnets in a plane of the diaphragm is at least 0.3 T;

(d) wherein at least 60% of an active area of the diaphragm are covered by a voice coil; and wherein the magnets and the voice coil are arranged relative to each other and wherein the tensioned diaphragm is under a tension such as to allow pistonic movement of the active area of the diaphragm to thereby reduce dispersion of sound.

2. The full-range transducer of claim 1 wherein the distance between the at least two of the magnets is at least 5 mm.

3. The full-range transducer of claim 1 wherein the average magnetic flux density between the at least two magnets in a plane perpendicular to the diaphragm is at least 0.45 T.

4. The full-range transducer of claim 1 wherein the average magnetic flux density between the at least two magnets in a plane perpendicular to the diaphragm is at least 0.55 T.

5. The full-range transducer of claim 1 wherein the average magnetic flux density between the third magnet and one of the at least two magnets in a plane of the diaphragm is at least 0.35 T.

6. The full-range transducer of claim 1 wherein the average magnetic flux density between the third magnet and one of the at least two magnets in a plane of the diaphragm is at least 0.4 T.

7. The full-range transducer of claim 1 wherein at least 70% of the active area of the diaphragm are covered by the voice coil.

8. The full-range transducer of claim 1 wherein the diaphragm comprises a tensioned polyamide membrane.

9. The full-range transducer of claim 1 wherein the diaphragm comprises a tensioned polyester membrane.

10. The full-range transducer of claim 1 wherein at least 95% of the active area of the diaphragm has substantially the same tension.

11. The full-range transducer of claim 1 wherein the distance between the at least two of the magnets is at least 5 mm, wherein the average magnetic flux density between the at least two magnets in a plane perpendicular to the diaphragm is at least 0.55 T, and wherein the average magnetic flux density between the third magnet and one of the at least two magnets in a plane of the diaphragm is at least 0.4 T.

12. The full-range transducer of claim 1 wherein the plurality of magnets are on each side of the diaphragm arranged in parallel with alternating polarity in neighboring magnets and in same polarity in opposing magnets.

13. The full-range transducer of claim 1 wherein the at least two magnets are coupled to each other by a spacer element.

14. The full-range transducer of claim 1 wherein the at least two magnets comprise a rare earth metal.

15. An array of speakers comprising a full-range transducer according to claim 1.

* * * * *